United States Patent [19]

Phillips

[11] Patent Number: 5,033,248

[45] Date of Patent: Jul. 23, 1991

[54] REINFORCED CONCRETE BUILDING AND METHOD OF CONSTRUCTION

[76] Inventor: Charles N. Phillips, 8135 Jackrabbit Rd., Houston, Tex. 77095

[21] Appl. No.: 550,301

[22] Filed: Jul. 9, 1990

Related U.S. Application Data

[62] Division of Ser. No. 461,309, Jan. 5, 1990, Pat. No. 4,970,838.

[51] Int. Cl.[5] ..... E04G 21/00

[52] U.S. Cl. ..... 52/743; 52/745; 52/747

[58] Field of Search ..... 52/743, 745, 746, 747

[56] References Cited

U.S. PATENT DOCUMENTS

| | | | |
|---|---|---|---|
| 3,775,240 | 11/1973 | Harvey . | |
| 4,059,939 | 11/1977 | Elliott | 52/745 |
| 4,185,423 | 1/1980 | Gutierrez . | |
| 4,253,288 | 3/1981 | Chun . | |
| 4,419,768 | 10/1983 | Boden | 52/743 X |
| 4,454,702 | 6/1984 | Bonilla-Lugo et al. . | |

*Primary Examiner*—David A. Scherbel

*Assistant Examiner*—Creighton Smith

*Attorney, Agent, or Firm*—Dodge, Bushy, Moseley & Riddle

[57] ABSTRACT

A reinforced concrete building (10) is formed from a plurality of prefabricated modules (24) which may be assembled off site and then transported or shipped to the building construction site for installation and application of concrete (36). Each prefabricated module (24) includes a rectangular frame (40) having channel-shaped frame members 42, 44, 46, and 48 which form the ends and sides of the frame. An insulation layer 62 is mounted within the frame (40) in spaced relation to one side frame member (48). A channel-shaped concrete column form (72) is secured between the insulation layer (62) and the adjacent side frame member (48) to close the frame (40). A wire mesh layer (78) is secured to the outer surface of the frame (40) with an overhanging side portion (84). The prefabricated module (24) when shipped to a construction site receives reinforcing bars (30, 32) and concrete (36) is pneumatically applied for forming a reinforced concrete wall (16). A drywall panel (38) is then mounted on modules (40) for the interior of the building.

14 Claims, 6 Drawing Sheets

FIG. 4
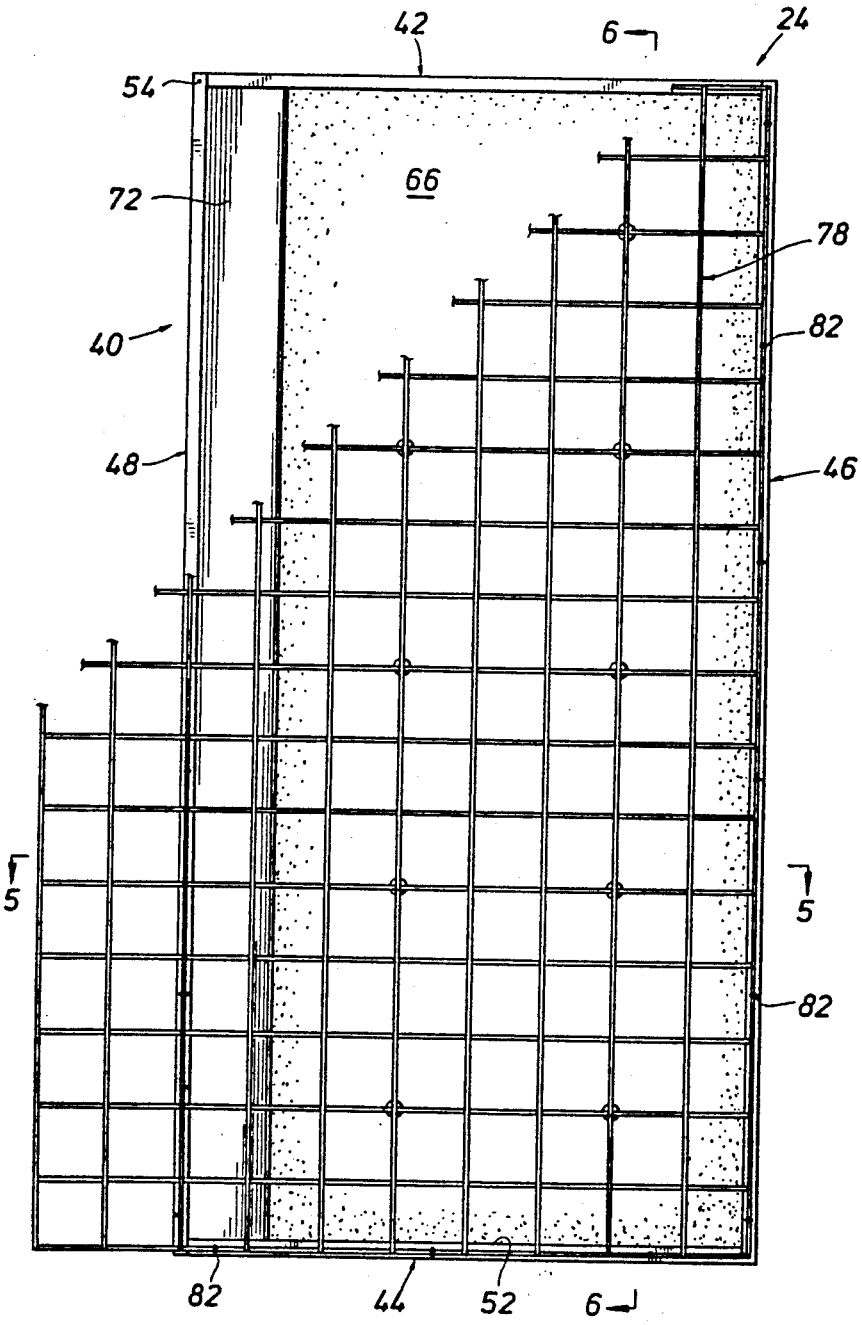
FIG. 6
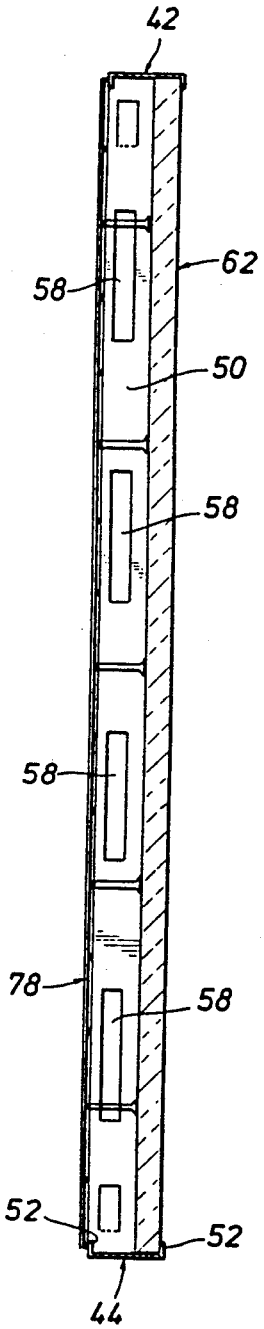
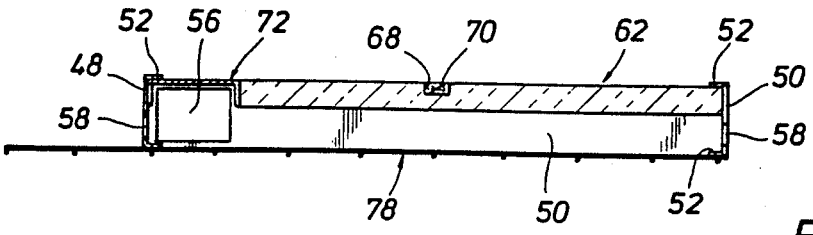
FIG. 5

FIG. 11
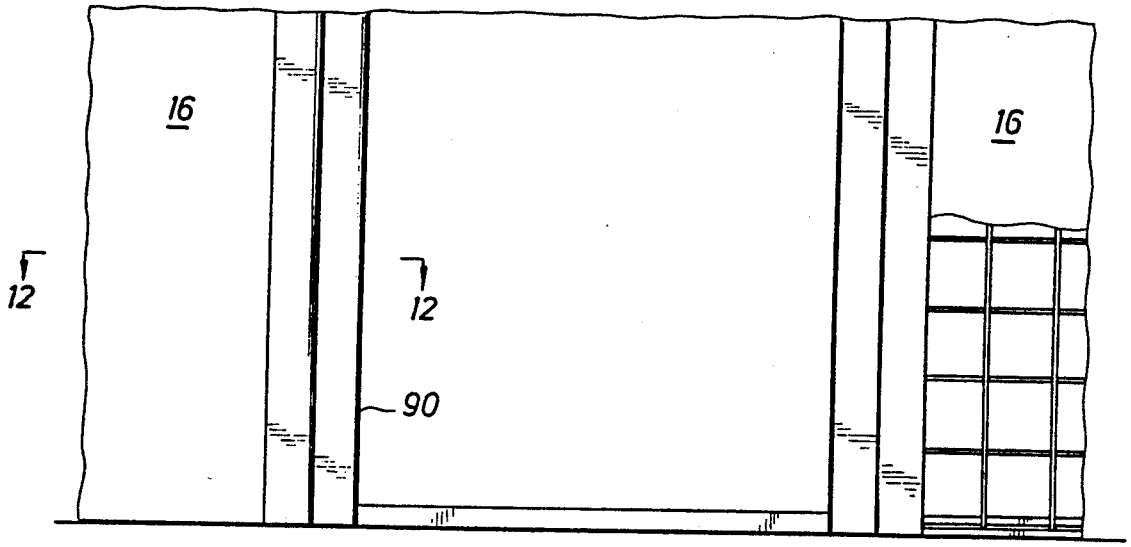
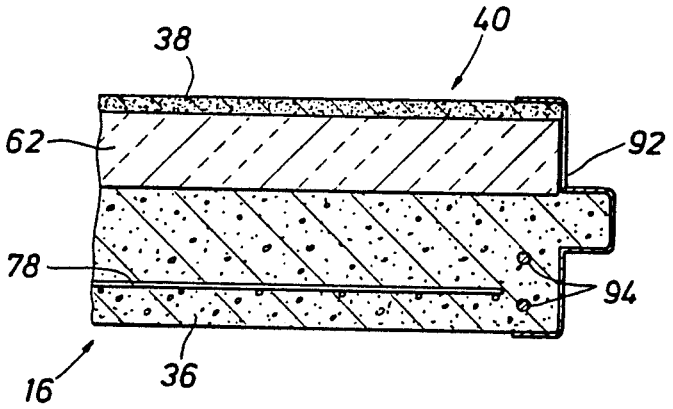
FIG. 12
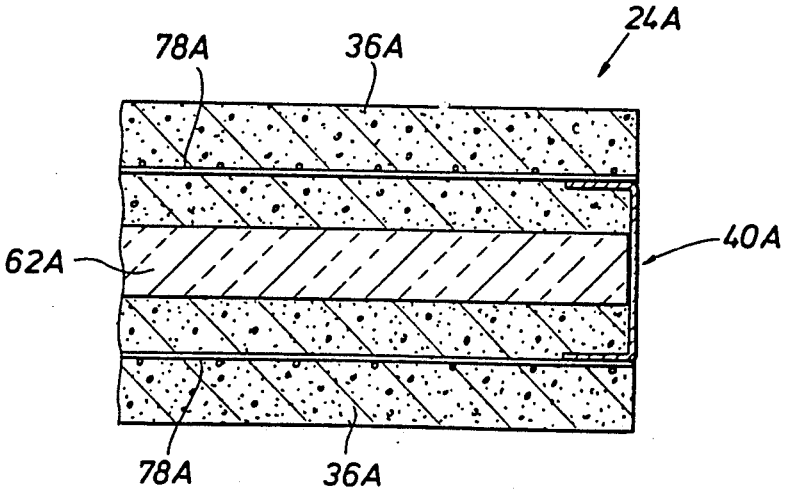
FIG. 13

REINFORCED CONCRETE BUILDING AND METHOD OF CONSTRUCTION

This application is a divisional of application Ser. No. 461,309, filed Jan. 5, 1990, now U.S. Pat. No. 4,970,833.

BACKGROUND OF THE INVENTION

This invention relates to a reinforced concrete building and a method of construction utilizing a plurality of prefabricated modules which may be constructed offsite and transported to the construction site.

Heretofore such as illustrated in U.S. Pat. No. 4,454,702 dated June 19, 1984, prefabricated building modules for construction of a reinforced concrete building have been provided and transported to the construction site for installation and application of concrete. The modular units are mounted on a footing at the construction site and connected to each other in an interfitting relation prior to the application of concrete, such as by pneumatic spraying of the concrete. The modular units shown in U.S. Pat. No. 4,454,702 include a layer of insulating material, such as a polystyrene foam material, with a wire mesh material on opposite sides of the insulating material. Spacers are provided between the wire mesh and foam material, and ties connected to the wire mesh material on opposite side of the insulation extend through openings in the foam material for maintaining the insulating material in proper position relative to the wire mesh. The positioning of the spacers and ties is time consuming and relatively complex.

SUMMARY OF THE INVENTION

The present invention is particularly directed to a reinforced concrete building construction utilizing an improved module and method of making the module in a relatively simple manner in a minimum of time. An outer generally rectangular frame for the module utilizes channel-shaped frame members. With one side of the frame open an insulating layer is inserted within the frame. Fasteners, such as wire staples or the like, extend through the frame members for securing the insulating layer within the frame in spaced relation to the open side of the frame. Then a side frame member is installed to close the frame and a separate longitudinally extending channel-shaped concrete column form is secured within the frame in the open space between the insulation and the side frame member to provide a form for a reinforced concrete column upon application of the concrete. A wire mesh material is then secured to the outer surface of the rectangular frame. Reinforcing rods are inserted within the module adjacent the concrete column form thereof at a building construction site for reinforcement and for attachment of the modules to a footing and roof of the building.

Thus, the insulation layer or core together with the channel-shaped concrete column form provide a backing against which concrete may be applied pneumatically. After the application of concrete on the side of the frame, a drywall may be mounted on the other side of the frame and secured to the insulation layer by suitable fasteners.

It is an object of this invention to provide a reinforced concrete building construction and method of construction utilizing a plurality of improved prefabricated modules which may be constructed offsite and transported to the construction site for installation and subsequent application of concrete.

A further object of this invention is to provide a method of making the improved module utilizing a rectangular frame with concrete being applied against an insulating layer in the frame from only one side of the frame thereby to permit the mounting of a drywall to the opposite side of the frame.

An additional object of the invention is to provide an improved prefabricated module having a rectangular frame and a longitudinally extending concrete column form extending between the ends of the frame and adapted to receive reinforcing bars at the installation site to provide a form for a vertical reinforced concrete column upon the application of concrete.

Other objects, features, and advantages of this invention will become more apparent after referring to the following specifications and drawings.

DESCRIPTION OF THE DRAWINGS

FIG. 4 is an elevation of a single prefabricated module as constructed off site and adapted for shipment or transport to a construction site for installation and construction of the reinforced concrete building as shown in FIGS. 1-3;

FIG. 5 is an enlarged section along line 5—5 of FIG. 4;

FIG. 6 is an enlarged section along line 6—6 of FIG. 4;

FIG. 11 is an elevation of a door opening which is sawed or cut into the reinforced concrete building after the application of concrete;

FIG. 12 is a section taken generally along line 12—12 of FIG. 11 showing the door frame provided about the opening; and FIG. 13 is an enlarged section showing a modified module with a wire mesh layer on each side of the rectangular frame and concrete applied to both sides of the module.

DESCRIPTION OF THE INVENTION

Figure 1:
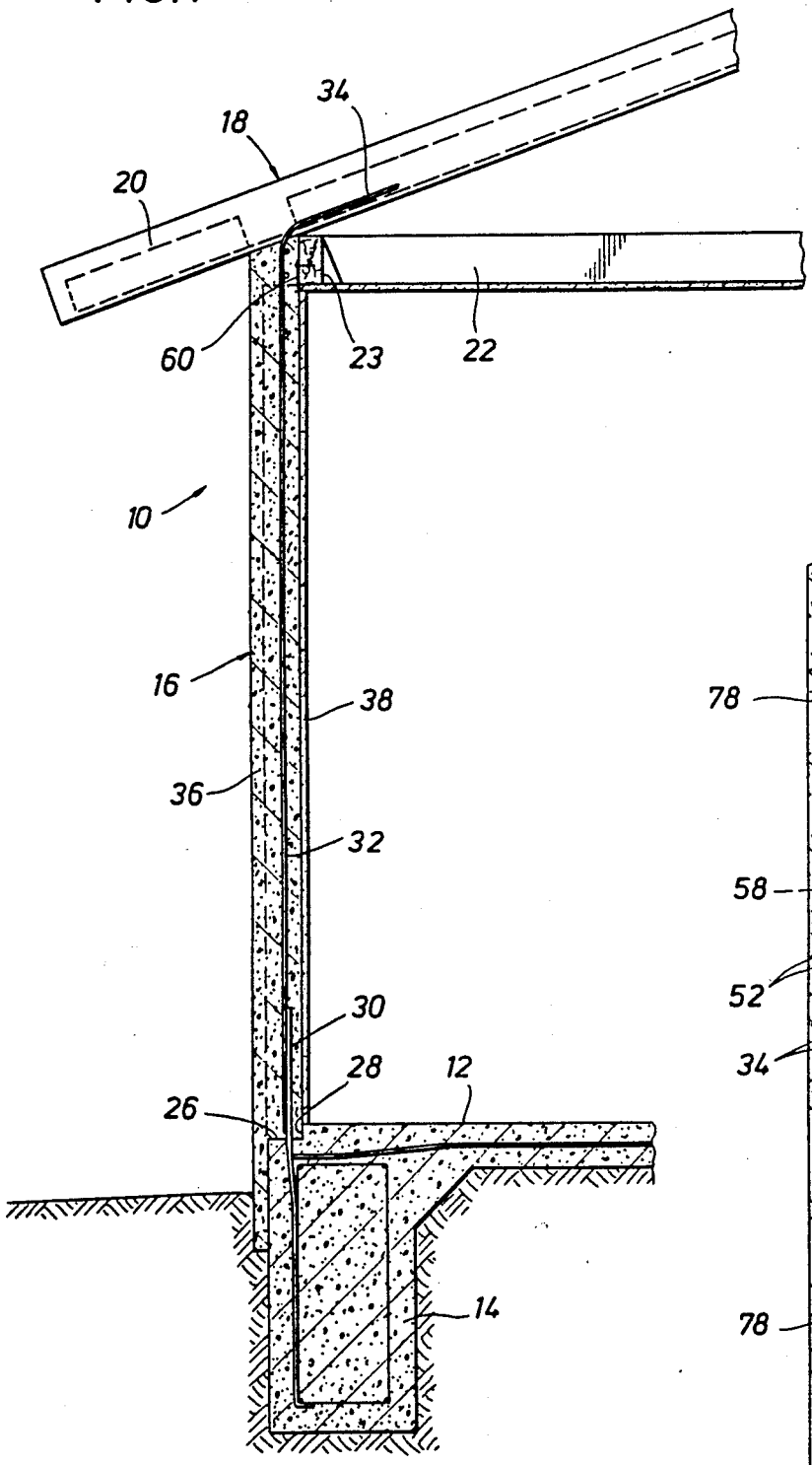
FIG. 1 is a section of a portion of a reinforced concrete building utilizing the improved prefabricated modules of this invention.
Figure 3:
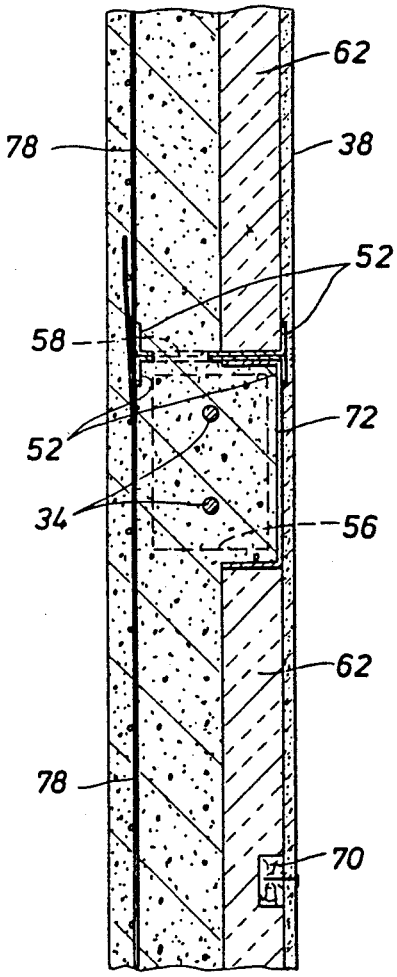
FIG. 3 is an enlarged section along line 3—3 of FIG. 2.
Figure 2:
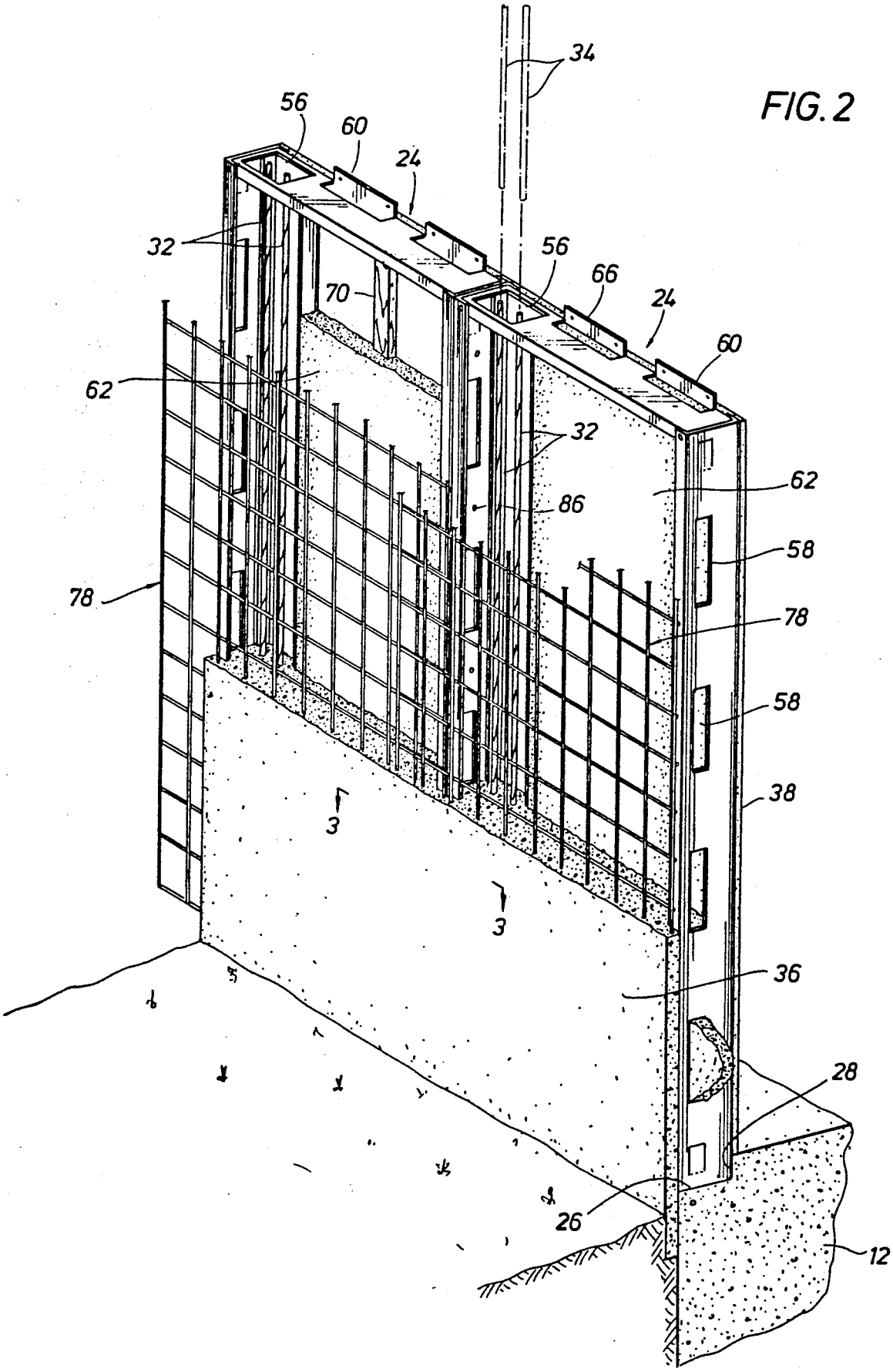
FIG. 2 is a perspective view of a portion of the reinforced concrete building of FIG. 1 showing two modules connected to each other with concrete on one side of the module and a drywall panel on the other side, the concrete being broken away to show various members of the modules.
Figure 7:
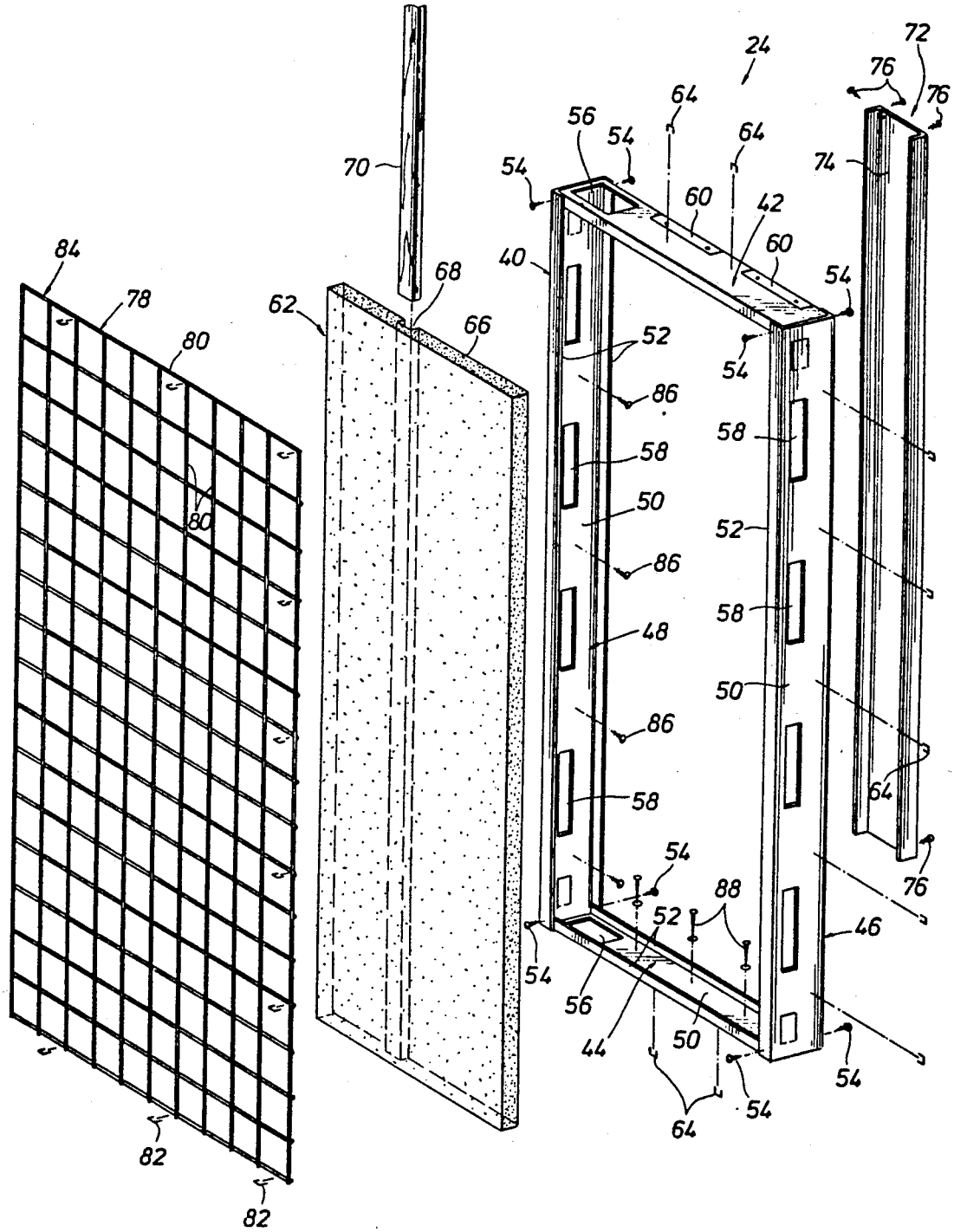
FIG. 7 is an exploded view of the prefabricated module shown in FIG. 4 showing the separate members comprising the module and including the fasteners for securing the various members of the module.

Referring now to FIGS. 1-3, a reinforced concrete building is shown particularly at 10 including a lower concrete floor slab 12 supported by a footing or pier 14. A vertical wall is shown generally at 16 and a roof is shown generally at 18 including a gable 20. Horizontally extending joists 22 extend between walls of the building 10. A wooden nailing member 23 is providing adjacent the outer end of joints 22 at sidewall 16.

Sidewall 16 is formed from a plurality of prefabricated modules illustrated generally at 24 having their lower end supported at 26 on slab 12 and abutting a ledge 28 on slab 12 for positioning modules 24. For mounting modules 24 on slab 12, a pair of dowels shown at 30 are received within an opening in module 24 for positioning module 24 and also to provide reinforcing for a concrete column formed by module 24 as will be explained further. Reinforcing bars 32 which are mounted at the construction site location are welded or secured to dowels 30 and have end portions 34 extending through a suitable opening in module 24 for connection of module 24 to roof 18. Extending end portions 34 of reinforcing rods 32 are bent downwardly for connection to roof 18 as shown particularly in FIG. 1 and prior to the application of concrete.

After installation of module 24, concrete 36, such as Gunite or shotcrete, is applied pneumatically to the outer surface of modules 24. Thereafter, a drywall panel or board 38 is secured to the inner surface of modules 24 which provides a smooth surface for the inside of the building for application of paint, wallpaper, or the like.

FIG. 2 is a perspective of a portion of sidewall 16 showing a pair of connected prefabricated modules 24 after insertion of reinforcing bars 34 and the application of concrete 36 from the outer side of module 24. Drywall panel 38 is mounted on an opposite inner side thereof at the installation site. Concrete 36 and various other members are broken away in FIG. 2 to show modules 24 which may be assembled off site and then transported to the construction site for installation and application of concrete.

Figure 10:
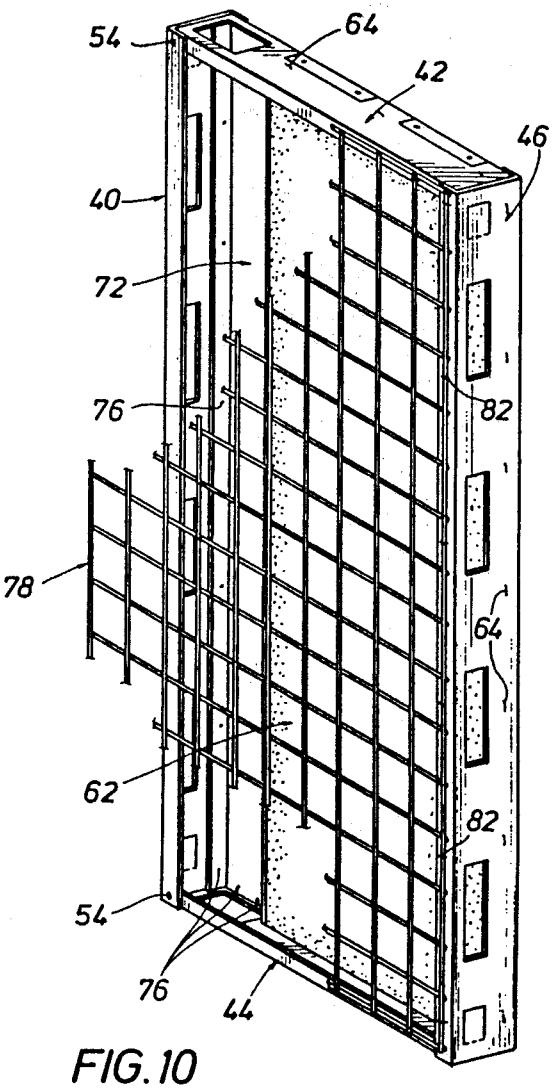
FIGS. 8-10 show the steps in the assembly of the module shown in FIGS. 4-7 with FIG. 8 illustrating the first step including frame members of the rectangular frame connected to each other, FIG. 9 showing a second step in which insulation is inserted within the open side of the frame and the frame closed by addition of the fourth frame member, and FIG. 10 showing the completed module with the channel-shaped form added for the concrete column and the wire mesh layer secured to the outer surface of the frame members.
Figure 9:
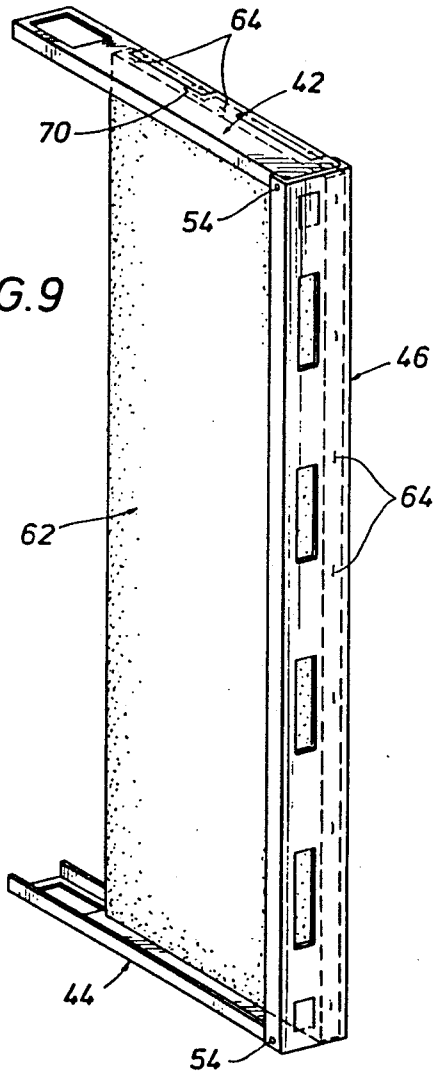
Figure 8:
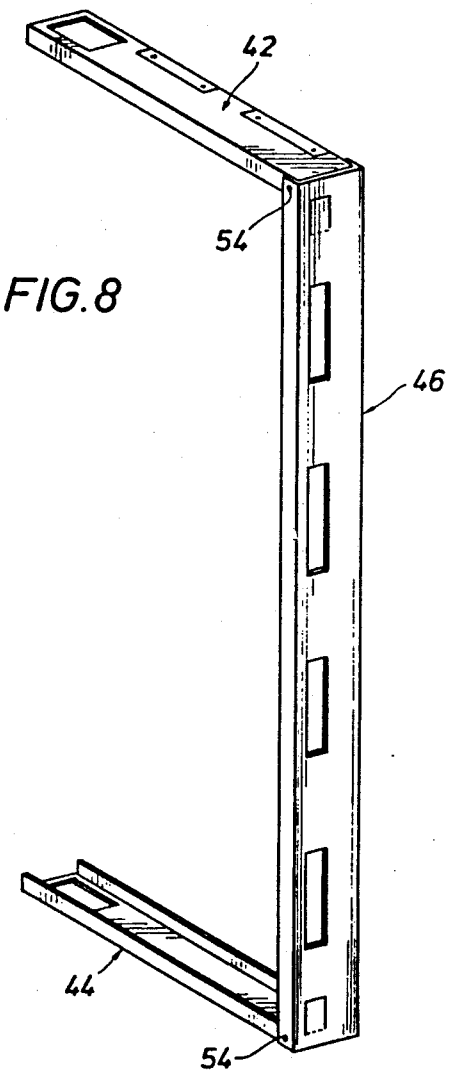

FIGS. 4–7 show the assembled prefabricated module 24 as utilized in the reinforced concrete building 10 of FIGS. 1–3. FIGS. 8–10 illustrate the steps involved in the assembly of the prefabricated module 24 as shown in FIGS. 4–7.

Referring first to FIGS. 4–7, module 24 includes a rectangular frame generally indicated at 40. Frame 40 is formed of two channel-shaped end frame members 42 and 44 connected by channel-shaped side frame members 46 and 48. Frame members 42 and 44 form the upper and lower ends of frame 40 while frame members 46 and 48 form the sides of frame 40. Each channel-shaped frame member 42, 44, 46, and 48 has a web 50 and extending flanges or legs 52. Adjacent frame members are connected to each other by screws 54. End frame members 42 and 44 have aligned openings 56 therein for receiving reinforcing bars 32 at the installation site. Side frame members 46 and 48 have openings 58 therein to permit the flow of concrete therethrough for the securement of frame 40 within wall 16. Upwardly foldable flaps are formed by clips 60 in upper end frame member 42 and may be folded upwardly in contact with nailing member 60 for securement thereto to secure module 24 to the gable or roof 18 at the construction site as shown in FIG. 1.

Mounted within rectangular frame 40 is an insulation layer or panel generally indicated at 62 and formed of a foam material, such as polystyrene. Insulation layer 62 is spaced from side frame member 48 and is secured to frame members 42, 44, and 46 by suitable staples 64 extending through the web 50 of the channel-shaped frame members 42, 44, and 46. The outer surface 66 of insulation layer 62 is positioned adjacent the inner flanges 52 of the frame members 42, 44, and 46. A groove or notch 68 is provided along the length of insulating layer 62 for receiving a wooden nailing strip 70 flush with the outer surface 66 of insulating layer 62. Nailing strip 70 may be utilized for the securement of drywall panel 38 at the construction site.

A channel-shaped concrete column form is indicated generally at 72 and is mounted in the space between insulating layer 62 and side frame member 48. The outer surface of web 74 of channel-shaped form 72 is flush with outer surface 66 of insulation layer 62 to form a smooth continuation thereof. Screws 76 secure form 72 to the adjacent flanges 52 of frame members 42, 44, and 48.

A wire mesh layer shown generally at 78 is comprised of connected wire members 80 and is mounted on the outer surface of frame 40 adjacent flanges 52. Staples 82 secure wire mesh layer 78 to flanges 52 of frame 40 and a side portion 84 of wire mesh layer 78 extends beyond side frame member 48 in an overhanging relation to frame 40 for overlapping an adjacent module 24 as shown in FIG. 2. Upon installation of modules 24 at the construction site, screws 86 are provided for connecting contacting webs 50 of adjacent modules 24 to secure the modules together. Also, concrete bolts 88 may be driven from a suitable gun through web 50 of lower end frame member 44 into slab 12 at the installation site for securement of module 24.

Referring now to FIGS. 8–10, the assembly steps for forming the prefabricated module 24 shown in FIG. 4 are illustrated. First, as shown in FIG. 8, three frame members 42, 44, and 46 are connected by screws 54 to form the upper and lower ends and one side of frame 40 with one side being open. Then, as shown in FIG. 9, insulation layer 62 is inserted from the open side against the inner surface of flanges 52 of frame members 42, 44, and 46. Staples 64 are inserted through web 50 of the frame members for securement of insulation layer 62 while spaced from the open side. Next, the side frame member 48 is secured to end frame members 42 and 44 by screws 54. Then, channel-shaped concrete column form 72 is positioned in the open space between insulation layer 62 and side frame member 48 to close the open space thereat. Screws 76 secure concrete column form 72 to frame members 42, 44, and 48. Wire mesh layer 78 is then secured to flanges 52 of frame members 42, 44, 46, and 48 with extension 84 overhanging side frame member 48. Module 24 is now completed for shipment or transport to the construction site for installation and the application of concrete.

At the construction site, modules 24 are positioned on slab 12 in side-by-side relation while supported at 26 in abutting relation to ledge 28 as shown in FIG. 1 and with dowels 30 being received within openings 56 for accurate positioning of modules 24. Concrete bolts 38 are shot through lower frame members 44 into concrete slab 1 for securement of modules 24. Side frame member 48 of one module 24 is in contact relation with side frame member 46 of an adjacent module 24. Screws 86 fasten side frame members 46 and 48 of adjacent modules 24 to each other. Reinforcing bars 32 are then fitted through opening 56 in upper frame member 42 and welded to lower dowels 30. Extended end portions 34 of reinforcing bars 32 may be bent downwardly for securement to roof 18 and the application of concrete.

Now, concrete 36 is applied pneumatically from the outer side of each module 24 against insulation layer 62 and concrete column form 72 to cover module 24 and provide a concrete thickness of around one inch outside frame 40. The outer concrete surface is screeded to a smooth or rough finish as desired on all walls. Then, a drywall panel 38 is mounted on the inner surface of module 24 and is secured to nailing strip 70 and insulation panel 60 by suitable fasteners.

Openings for doors or windows may be provided such as shown in FIGS. 11 and 12, by sawing the completed wall 16 with a suitable saw having a carborundum type blade. After cutting a opening such as shown at 90, the opening may be suitably framed by additional wooden or metal framing members as desired. For example, as shown in FIG. 12, a metal door frame 92 is provided to form a cap about opening 90. Additional reinforcing rods such as shown at 94 may be provided about opening 90 and concrete is applied pneumatically for finishing of the opening for a door or window.

Referring to FIG. 13, an enlarged section of a modified wall 16A formed of a plurality of modules 24A is illustrated in which an insulating layer 62A is centered within frame 40A and a wire mesh layer 78A is secured to the frame members of frame 40A on both sides of insulating layer 62A. Then, concrete 36A is applied pneumatically from both sides of frame 40A to provide a thickness of concrete of around one inch on each side of frame 40A. Thus, an increased thickness wall 16A is provided by the pneumatic application of concrete on both sides of wall 16A as may be desired for certain types of buildings.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method of making a prefabricated module for installation in a building construction and for subsequent application of concrete; said method comprising the following steps:

providing a rectangular frame including four frame members forming opposed ends and opposed sides of the frame;

mounting an insulating layer within the rectangular form in spaced relation to one of said side frame members;

mounting a concrete column form between the insulating layer and said one side frame member to fill the space therebetween;

securing the concrete column form to opposed end frame members of said frame;

providing a wire mesh layer for the frame of a width greater than the width of the rectangular frame to form a side portion overhanging a side of the module; and securing the wire mesh layer and insulating layer to the frame in spaced parallel relation to each other with the overhanging side portion of the wire mesh layer extending a substantial distance beyond the side of the frame.

2. A method of making a prefabricated module for subsequent installation and application of concrete; said method comprising the following steps:

providing a rectangular frame formed of four generally similar frame members to define opposed ends and sides of the frame;

mounting an insulating layer on the rectangular frame in spaced relation to one of the side frame members;

mounting a generally channel-shaped concrete column form between the insulating layer and said one side frame member to fill the space therebetween;

securing the concrete form to opposed end frame members of the rectangular frame; and mounting a wire mesh layer to the frame in spaced parallel relation to the insulating layer.

3. The method as set forth in claim 2 including the steps of providing a longitudinally extending groove along the outer surface of said insulating layer; and mounting a nailing strip within said groove with the nailing strip being generally flush with the outer surface of said insulating layer.

4. A method of making a prefabricated module for subsequent installation and application of concrete; said method comprising the following steps:

providing four generally similar frame members for forming sides and ends of a rectangular frame;

connecting three frame members together to form two ends and one side of the rectangular frame with one side being open;

inserting an insulating layer within the open side of the frame;

closing the open side of said frame after insertion of said insulating layer;

providing a concrete column form adjacent the insulating layer extending between opposed ends of the frame;

mounting a wire mesh layer on said frame; and securing the wire mesh layer and insulating layer in spaced parallel relation to each other on the frame.

5. A method of making a prefabricated module for subsequent installation and application of concrete; said method comprising the following steps;

providing four generally similar frame members for forming sides and ends of a rectangular frame;

connecting three frame members together to form two ends and one side of the rectangular frame with one side being open;

inserting a insulating layer within the open side of the frame;

connecting a fourth frame member to the rectangular frame to close the open side with the insulating layer being spaced from said fourth frame member of the rectangular frame but in contact with the remaining frame members; and mounting a channel-shaped concrete column form between said fourth frame member and said insulating layer with the outer surface of the channel-shaped form forming a generally smooth continuation of the outer surface of said insulating layer; and securing said insulating layer and said channel-shaped form to said frame so that said channel-shaped form and insulating layer form a backing surface for the subsequent pneumatic application of concrete.

6. The method as set forth in claim 5 further including the steps of forming a groove along the outer surface of said insulating layer; and inserting a longitudinally extending wooden mailing strip within said groove having an outer surface forming a smooth continuation of the outer surface of said insulating layer.

7. The method as set forth in claim 5 further including the step of securing a drywall panel to the outer surface of said insulating layer and said concrete form.

8. The method as set forth in claim 5 further including the step of mounting metal staples through said frame members and said insulating layer for securing said layer to said rectangular frame at a predetermined position.

9. The method as set forth in claim 5 further including the step of mounting at the construction site a pair of reinforcing rods adjacent and inwardly of said channel-shaped concrete column form extending between opposed end frame members for providing reinforcement for a concrete column formed by said form upon installation and application of concrete.

10. A method of making a reinforced concrete building including a plurality of prefabricated modules for forming the vertical walls; said method including the following steps:

a. forming a plurality of modules with each module formed in accordance with the following steps:
   (i) connecting four generally similar frame members for forming side and end frame members of a rectangular frame;
   (ii) mounting an insulation layer within the frame with said layer being in spaced relation to one of the side frame members;
   (iii) mounting a generally channel-shaped concrete column form between said one side frame member and said insulating layer with the outer surface of the channel-shaped form forming a generally smooth continuation of the outer surface of said insulating layer; and
   (iv) securing said insulating layer and said channel-shaped form to said frame members to form a continuous backing surface between said frame members;

b. forming a concrete footing for said building;

c. mounting said plurality of modules as formed by the steps set forth above on said footing in side-by-side relation and connecting adjacent modules to each other; and d. pneumatically applying concrete from the outer side of said modules against said insulating layers and said channel shaped concrete column forms of said modules to cover said modules with a thickness of concrete of at least around one inch and to provide a concrete column for each module adjacent the channel-shaped concrete column form thereof.

11. A method of making a reinforced concrete building as set forth in claim 10 further including the steps of:

mounting a drywall panel on the inner surface of the modules; and securing the drywall panel to the insulating layer of the modules.

12. A method of making a reinforced concrete building as set forth in claim 10 further including the steps of:

mounting a pair of reinforcing rods adjacent and inwardly of said channel-shaped concrete form of each module extending between opposed end frame members thereof;

providing a roof over the vertical walls formed by said modules; and securing extending end portions of said reinforcing rods to said roof for connecting the modules thereto upon the application of concrete.

13. A method of making a reinforced concrete building as set forth in claim 11 including forming each module with the step of:

securing a wire mesh material to said frame in parallel spaced relation to said insulation layer thereof.

14. A method of making a reinforced concrete building as set forth in claim 13 further including forming each module in accordance with the following steps:

mounting a second wire mesh layer adjacent the inner side of said insulating layer opposite said first mentioned wire mesh layer; and pneumatically applying concrete to the inner side of said modules.

* * * * *